US006792237B2

(12) United States Patent
Takagi et al.

(10) Patent No.: US 6,792,237 B2
(45) Date of Patent: Sep. 14, 2004

(54) FIXING BELT AND FIXING APPARATUS EQUIPPED WITH SAME

(75) Inventors: Masao Takagi, Tokyo (JP); Goki Inukai, Tokyo (JP)

(73) Assignee: Nitto Koygo Co., Ltd., Tokyo (JP)

( * ) Notice: Subject to any disclaimer, the term of this patent is extended or adjusted under 35 U.S.C. 154(b) by 0 days.

(21) Appl. No.: 10/411,297

(22) Filed: Apr. 11, 2003

(65) Prior Publication Data

US 2003/0185606 A1 Oct. 2, 2003

Related U.S. Application Data

(63) Continuation-in-part of application No. 10/212,809, filed on Aug. 7, 2002, now Pat. No. 6,647,238.

(30) Foreign Application Priority Data

Apr. 2, 2002 (JP) ..... 2002-100058

(51) Int. Cl.[7] ..... G03G 15/20
(52) U.S. Cl. ..... 399/329; 219/216; 399/333
(58) Field of Search ..... 219/216; 399/320, 399/328, 329, 330, 331, 333; 430/124

(56) References Cited

U.S. PATENT DOCUMENTS 5,724,638 A * 3/1998 Isogai et al. ..... 399/333
6,434,355 B1 * 8/2002 Badesha et al. ..... 399/307

* cited by examiner

*Primary Examiner*—Hoang Ngo
(74) *Attorney, Agent, or Firm*—Westerman, Hattori, Daniels & Adrian, LLP

(57) ABSTRACT

The present invention provides a fixing belt adapted to move circularly and cooperate with a pressing member to form a nip region for fixing an unfixed toner image on a recording medium, capable of achieving a desirably enhanced durability even under high-temperature atmosphere. The fixing belt comprises a substrate formed of an endless-shaped electroformed sheet consisting essentially of a nickel-carbon alloy containing 0.05 to 0.12 mass % of carbon. The carbon content may be adjusted in proportion to the amount of a secondary brightening agent to be added to an electrolytic bath or to a cathode current density to be sent to the electrolytic bath. The secondary brightening agent may be 2-butyne-1,4-diol. In the fixing belt of the present invention, the substrate may have a surface provided with a releasing layer which may be formed as a single layer or multilayer made of a material having heat resistance and non-adhesive, such as silicone rubber, fluorine rubber, fluororesin, or their mixture.

12 Claims, 3 Drawing Sheets

FIXING BELT AND FIXING APPARATUS EQUIPPED WITH SAME

CROSS REFERENCE TO RELATED APPLICATION

This is a continuation-in-part application of a U.S. patent application, Ser. No. 10/212,809, filed Aug. 7, 2002 now U.S. Pat. No. 6,647,238.

TECHNICAL FIELD

The present invention relates to a fixing belt adapted to move circularly and cooperate with a pressing member to form a nip region for fixing an unfixed toner image on a recording medium. The present invention also relates to a fixing apparatus equipped with such a fixing belt.

PRIOR ART

Heretofore, a so-called heating roller system has been widely used in a fixing apparatus for electrophotographic equipment. The heating roller system typically comprises a pair of rollers each having a surface coated with a non-adhesive material, and a heat source provided inside each of the rollers. A fixing operation of this system is performed by rotating the pair of rollers with applying an appropriate pressure therebetween, and passing a recording medium with a transferred or unfixed toner between the rollers. On the other hand, an alternative technique has been developed in which a belt is wound between one of the above pair of rollers and a third roller, and unfixed toner on a recording media is pressed by the surface of the belt.

By way of example of the above technique, Japanese Patent Laid-Open Publication No. 06-318001 discloses a fixing apparatus based on a belt fixing system as shown in FIG. 2 thereof. The disclosed fixing apparatus comprises a fixing roller R1, a pressing roller R2, a heating/tension roller R3, and a fixing belt B wound between the fixing roller R1 and the heating/tension roller R3. The fixing apparatus further includes a guide plate G disposed under the lower portion of the fixing belt B with leaving a certain space which defines a heating passage P between the lower portion of the heated fixing belt B and the guide plate G to allow a recording medium D to be preheated while passing therethrough. The preheating of the recording medium D having an unfixed toner image supported thereon makes it possible to set the temperature of a nip region lower, which provides an enhanced releasability between the fixing belt B and the toner, and a desirable clearness of the fixed image without offset.

With respect to the fixing apparatus based on the belt fixing system as described above, the applicant has filed a patent application (Japanese Patent Application No. 07-088357) relating to an improved technology in which an interior angle defined by a first straight line which connects the center of a fixing roller and a contact point between the lower portion of the fixing roller and a fixing belt and a second straight line which connects the contact point and the center of a pressing roller is arranged in the range of 90° to 175° to provide a stable and high-quality fixed image.

As with the fixing apparatus based on the conventional belt fixing system, it is necessary for the aforementioned improved belt-type fixing apparatus to employ a fixing belt having an excellent heat conductivity and high dimensional accuracy. If a belt made of a polyimide resin as a heat-resistant polymeric material is used as the fixing belt, its insufficient heat conductivity will undesirably place a limit on the increasable range of a fixing speed, and increase the time-period required for heating the fixing belt up to a given temperature in a startup operation. While a fixing belt made of metal such as nickel is excellent in heat conductivity and dimensional accuracy, the usable period of the metal fixing belt is disadvantageously limited due to its degraded strength through a heat treatment required for providing a releasing layer thereon, resulting in deficiency of practicability.

From this point of view, the applicant has proposed a technique intended to achieve a long-life metal endless-type fixing belt suitable for belt-type fixing apparatuses and provide a metal fixing belt having a high heat conductivity, high rigidity, excellent heat resistance and excellent fatigue strength. This technique has been applied for a patent and granted as Japanese Patent No. 2706432.

The above granted patent discloses a fixing belt adapted to move circularly and cooperate with a pressing member to form a nip region for thermo-compression-bonding and fixing an unfixed toner image onto a recording medium. This fixing belt comprises a substrate formed of an endless-shaped electroformed sheet which consists of a nickel-manganese alloy containing 0.05 to 0.6 mass % of manganese and has a micro-Vickers hardness of 450 to 650.

The patented technology having these features can achieve the aforementioned objects. However, it leaves to be improved in the durability under high-temperature atmosphere, and the need of a fixing belt having further improved durability still exists.

SUMMARY OF THE INVENTION

In view of the above circumstances, it is therefore an object of the present invention to provide a fixing belt capable of achieving a desirably enhanced durability even under high-temperature atmosphere.

In order to solve the above problem and achieve the object, according to a first aspect of the present invention, there is provided a fixing belt adapted to move circularly and cooperate with a pressing member to form a nip region for fixing an unfixed toner image on a recording medium. The fixing belt comprises a substrate formed of an endless-shaped electroformed sheet consisting of a nickel-carbon alloy containing 0.05 to 0.12 mass % of carbon.

According to a second aspect of the present invention, the carbon content in the fixing belt is adjusted in a range of 0.055 to 0.10 mass %.

According to a third aspect of the present invention, the carbon content in the fixing belt is adjusted in proportion to the amount of a secondary brightening agent to be added to an electrolytic bath.

According to a fourth aspect of the present invention, the secondary brightening agent used in the fixing belt is 2-butyne-1,4-diol.

According to a fifth aspect of the present invention, the carbon content in the fixing belt may be adjusted in proportion to a cathode current density to be sent to an electrolytic bath.

According to a sixth aspect of the present invention, the substrate in the fixing belt has a surface provided with a releasing layer.

Further, according to a seventh aspect of the present invention, there is provided a fixing apparatus comprising a fixing roller, a pressing roller in rotational contact with the fixing roller at a given pressure, a heating roller disposed apart from the fixing roller, a fixing belt wound around both the heating and fixing rollers in an endless manner, and a heat-generating device for heating the fixing belt to heat unfixed toner on a sheet passing through a rotational contact region between the fixing and pressing rollers, whereby when the sheet having unfixed toner on a surface thereof is passed through the rotational contact region along one direction, the unfixed toner is fixed onto the sheet. The fixing belt includes a substrate formed of an endless-shaped electroformed sheet consisting of a nickel-carbon alloy containing 0.05 to 0.12 mass % of carbon.

In the present invention, the fixing belt essentially has an endless shape. Thus, the substrate of the fixing belt is prepared by an electroforming process using a master made of stainless steel or the like as a cathode and an electrolytic bath capable of electrocrystallizing a nickel-carbon alloy. In this case, the electrolytic bath may be a conventional nickel electrolytic bath such as a sulfamic acid solution, optionally added with an addition agent such as a PH regulator, a pit inhibitor or a brightening agent. The concentration of a secondary brightening agent based on an unsaturated organic compound, an electrolytic bath temperature, a cathode current density and/or other factor are controlled to obtain an electroformed product formed of a nickel-carbon alloy containing a desired content of carbon.

After cutting away the side ends of the electroformed product, the electroformed product is separated from the master. Then, the separated product is subjected to rinse, drying, machining and other treatment or processing so as to provide a substrate having desired shape and dimension.

Further, an optional primer is applied onto the surface of the substrate, and then a releasing layer may be formed thereon to produce the fixing belt of the present invention. The releasing layer may be formed as a single layer or multilayer made of a material having heat resistance and non-adhesive, such as silicone rubber, fluorine rubber, fluororesin, or their mixture.

The fixing belt of the present invention will repeatedly receive a bending stress when it moves circularly between the fixing and heating rollers with being wound around both the rollers. Thus, it is important to provide a sufficient fatigue resistance to the fixing belt. In view of this point, heat conductivity and dimensional stability, it is preferable to use metal in the substrate. A pure nickel electrocrystallized product has a poor mechanical strength due to its rough and large crystal structure, and thereby it has been difficult to provide a sufficient durability required for a material of the fixing belt. In order to obtain an improved electrocrystallized product having a fine or densified crystal structure, it is contemplable to add a brightening agent to the electrolytic bath. This provides an improved mechanical strength of the electrocrystallized product, but cannot produce a sufficient improvement in durability.

It has been found that the embrittlement due to repetitive bending was suppressed and the high-temperature durability could be significantly improved by selectively using as the substrate an endless-shaped electroformed sheet which consists of a nickel-carbon alloy having the content of carbon in the range of 0.05 to 0.12 mass % and has a durability particularly under high-temperature atmosphere.

The fixing belt of the present invention may be obtained by forming a releasing layer made of a material having heat resistance and non-adhesive, such as silicone rubber, fluorine rubber or fluororesin, on the surface of the substrate satisfying the above requirement of the carbon content. This fixing belt has an excellent releasability for toner even with an extremely reduced amount of releasing oil such as silicone oil, which prevents the toner from attaching to and contaminating the fixing belt, and thereby provides a clear image without generating any undesirable offset. In addition, the fixing belt exhibits an excellent long-term durability with undiminished stable quality.

DESCRIPTION OF THE PREFERRED EMBODIMENT

With reference to the drawings, the structure of a fixing belt according to one embodiment of the invention will now be described in detail, wherein the fixing belt is applied to a fixing apparatus for electrophotographic equipment.

General Description of Fixing Apparatus 10

Figure 1:
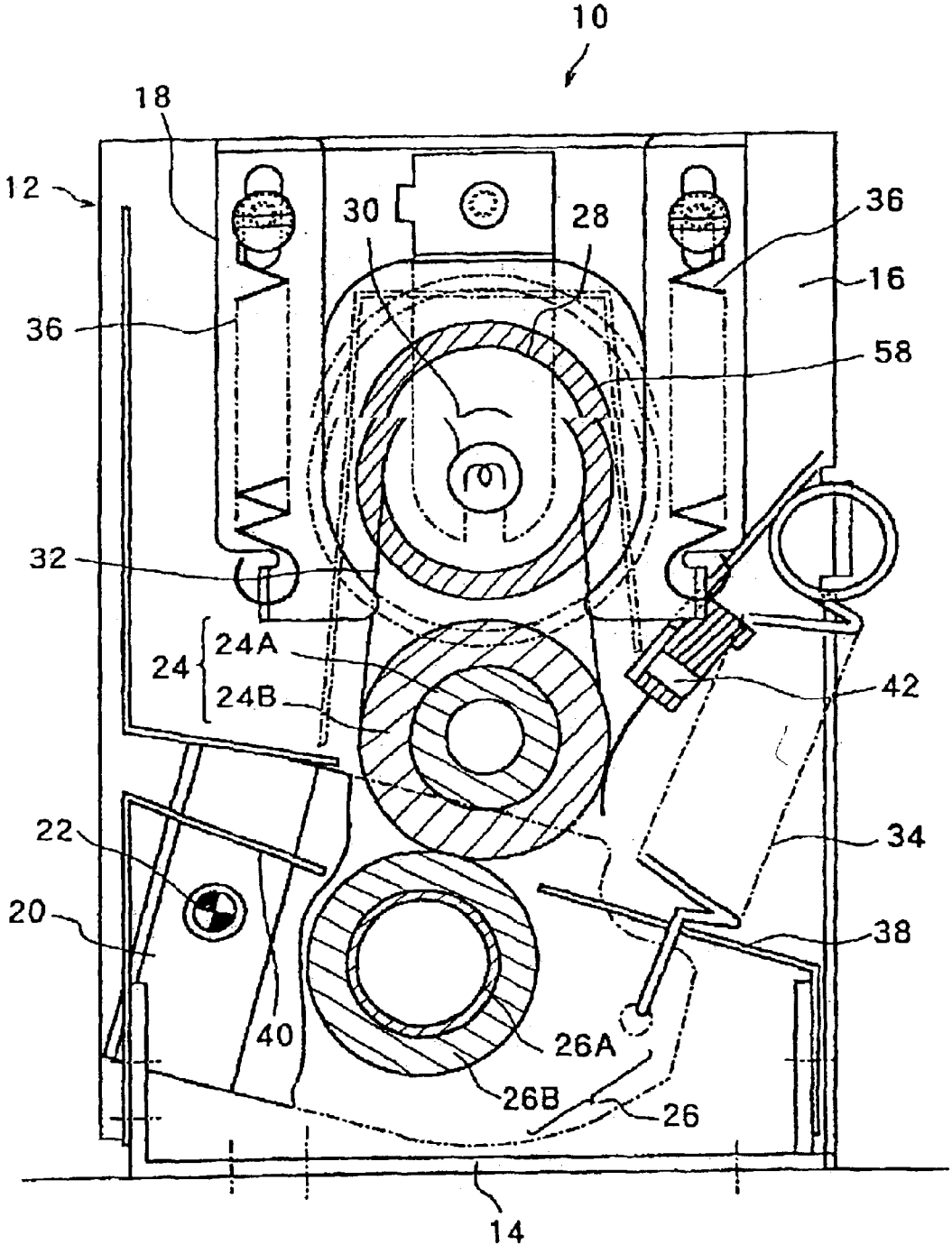
FIG. 1 is a sectional front view showing the structure of a fixing apparatus equipped with a fixing belt according to one embodiment of the present invention.

As shown in FIG. 1, a fixing apparatus 10 according to this embodiment includes a housing 12 as a housing structure to be fixed to a frame of electronic image forming equipment (not shown) such as an electronic printer. The housing 12 comprises a base plate 14 to be fixed directly to the frame of the equipment, and a pair of side plates 16 standing from the front and rear side edges of the base plate 14, respectively. In FIG. 1 being a front view, an unfixed sheet, or a sheet having unfixed toner on the upper surface thereof, is fed from right hand to left hand through a feeding mechanism (not shown), as described in detail later.

In the upper portion of the housing 12, a slidable bracket 18 is attached to both the side plates 16 in a slidable manner along the vertical direction in the figure, and a heating roller 28 (described later) is rotatably pivoted to the slidable bracket 18. In the lower portion of the housing 12, a swingable bracket 20 is supported by both the side plates 16 through a pivot shaft 22 in a swingable manner about the pivot shaft 22, and a pressing roller 26 (described later) is rotatably pivoted to the swingable bracket 20.

As a roller structure, the fixing apparatus 10 includes: a fixing roller 24 pivoted to both the side plates 16 rotatably about a fixed axis; a pressing roller 26 which is disposed approximately below the fixing roller 24 (specifically, obliquely leftward downward in the figure) to be in rotational contact with the fixing roller 24 and is supported by the swingable bracket 20 rotatably about a fixed axis arranged in parallel with the fixed axis of the fixing roller 24; and a heating roller 28 which is disposed approximately above the fixing roller 24 and is rotatably supported by the slidable bracket 18.

The fixing apparatus 10 further includes a heat source such as a halogen lamp provided inside the heating roller 28, and a fixing belt (heat transfer belt) 32 wound around both the fixing roller 24 and the heating roller 28 in an endless manner.

The fixing roller 24 is comprised of a resilient roller, while the pressing roller 26 is comprised of a roller having a higher hardness on the roller than that of the resilient roller, as described in detail later. A first coil spring 34 applies a biasing force to the swingable bracket 20 to rotate the swingable bracket 20 about the pivot shaft 22 in a direction for allowing the pressing roller 26 to be brought into press contact with the fixing roller 24. As a result, the fixing roller 24 and the pressing roller 26 are in rotational contact with one another at a given contact pressure in a rotational contact region (nip region) therebetween. This allows the fixing roller 24 to be dented in the rotational contact region, which provides a sufficient nip width.

The fixing apparatus 10 further includes a second coil springs 36 disposed between each of the right and left ends of the slidable bracket 18 and the corresponding side plate 16 to bias the heating roller 28 in a direction causing the heating roller 28 to get away from the fixing roller 24 so as to provide a given tension to the fixing belt 32. Two pairs of the second coil springs 36 are provided on the front and rear sides of the right end and on the front and rear sides of the left end, respectively.

The housing 12 is also provided with a feed guide plate 38 for guiding an unfixed sheet toward the rotational contact region and a discharge guide plate 40 for discharging a fixed sheet, or a sheet which has passed through the rotational contact region and completed the fixing operation, toward a discharge port. Further, the housing 12 is provided with a thermister 42 for detecting a surface temperature in a region of the fixing roller 24 which is not wound by the fixing belt 32 and located on the immediate upstream side of the rotational contact region with respect to the rotational direction of the fixing roller 24. The thermister 42 employed in this embodiment is a contact type operable to detect a surface temperature of an object by contacting the surface of the object.

The temperature detect position for the thermister 42 is not limited to the aforementioned peripheral surface of the fixing roller 24 which is not wound by the fixing belt 32, and the thermister 42 may be attached to detect a temperature in the peripheral surface of the fixing belt 32 which is wound around the periphery of the fixing roller 24 and located on the immediate upstream side of the rotational contact region with respect to the rotational direction of the fixing roller. In this case, the thermister 42 is preferably a non-contact type.

The leading end of the unfixed sheet supplied to the fixing apparatus 10 through the feeding mechanism 10 (not shown) is first brought into contact with the upper surface of the feed guide plate 38 and then fed obliquely upward with being guided by the feed guide plate 38. The leading end of the unfixed sheet guided by the feed guide plate 38 is brought into contact with the peripheral surface of the pressing roller 26, and then moved along the peripheral surface of the pressing roller 26 to enter into the rotational contact region between the fixing roller 24 and the pressing roller 26.

In the fixing apparatus 10 schematically constructed as described above, the unfixed sheet S is fed on the feed guide plate 38 through the feeding mechanism (not shown), and the back surface of the unfixed sheet S having no unfixed toner thereon is supported by the feed guide plate 38. Further, the unfixed sheet S is guided toward the rotational contact region (nip region) between the fixing roller 24 wound by the fixing belt 32 and the pressing roller 26. When the unfixed sheet S is compressedly passed through between the fixing roller 24 and the pressing roller 26, the unfixed toner will be thermo-compression-bonded on the sheet and fixed onto the sheet.

The above various structural elements will be individually described below.

Description of Pressing Roller 24

The fixing roller 24 comprises a core 24A rotatably pivoted on the side plate 16 through a bearing 44 (see FIG. 2), and a roller body 24B disposed on the periphery of the core 24A coaxially therewith and wound by the fixing belt 32. In this embodiment, the fixing roller 24 is arranged to have an outside diameter of 25.0 mm. Further, the core 24A is formed of an iron shaft having a diameter of 15 mm, and the roller body 24B is formed of a silicone rubber heat-resistant resilient material (specifically, ASKER C hardness of 23 degree on the roller) having a thickness of 5 mm which is attached to the peripheral of the core 24A.

Figure 2:
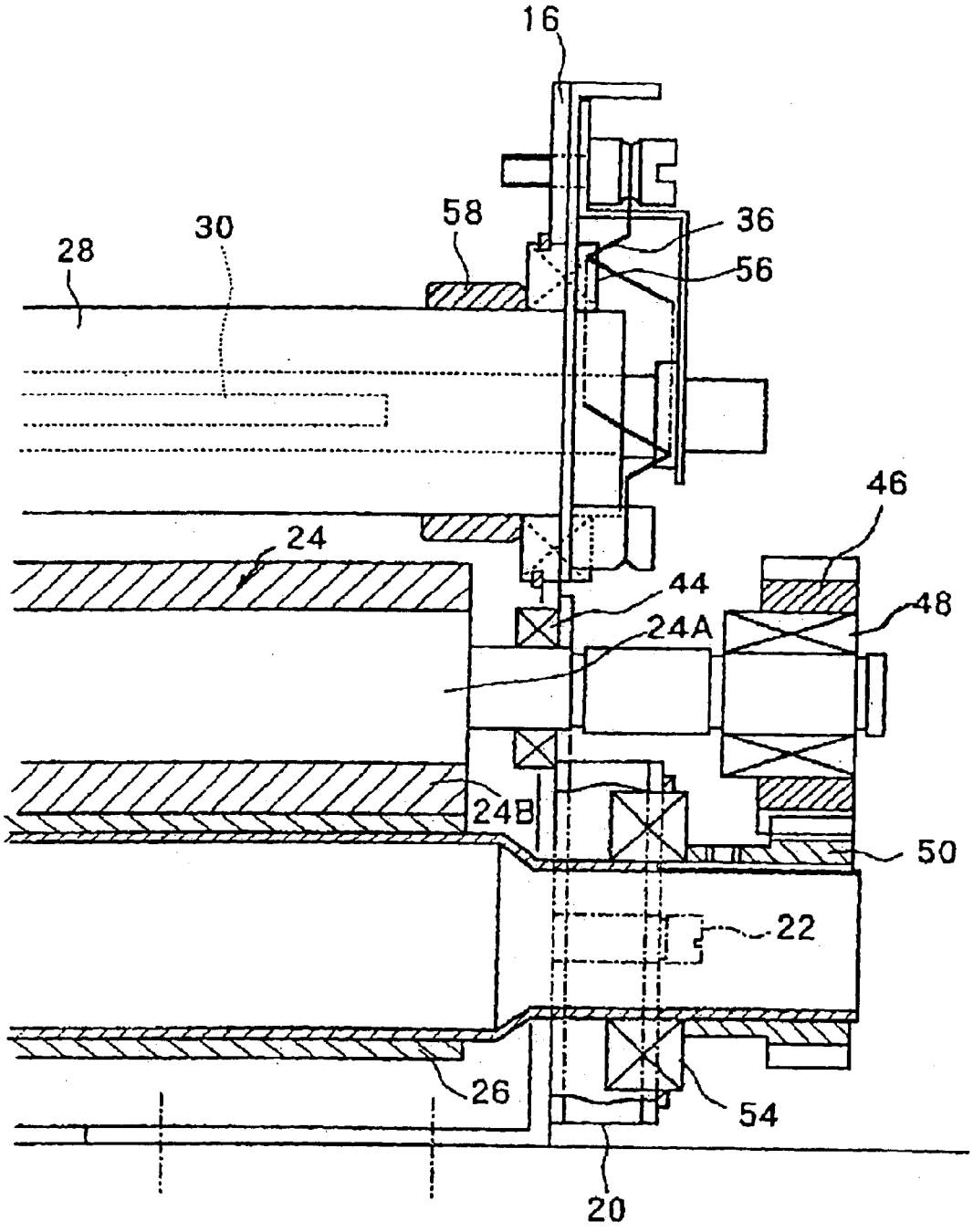
FIG. 2 is a sectional view showing a support structure at the respective ends of rollers in the fixing apparatus shown in FIG. 1.

As shown in FIG. 2, a first driven gear 46 is attached coaxially to a shaft provided at one of the ends of the core 24A through a one-way clutch 48 (described in detail later). The first driven gear 46 is engaged with a second driven gear 50 coaxially attached to one of the ends of a core 26A (described later) of the pressing roller 26. The second driven gear 50 is engaged with a drive gear (not shown) constituting a part of a driving mechanism 52. In this way, a driving force from the driving mechanism 52 is transmitted to the second driven gear 50 through the drive gear as a turning force counterclockwise in FIG. 1. Then, the counterclockwise turning force is transmitted to the first driven gear 46 as a turning force clockwise in FIG. 1, and the clockwise turning force is transmitted to the fixing roller 24 through the one-way clutch 48.

Description of One-Way Clutch 48

In this embodiment, the one-way clutch 48 is operable to allow the fixing roller 24 to be rotated relative to the first driven gear 46 clockwise in the figure, but to prevent the fixing roller 24 from being rotated relative to the first driven gear 46 counterclockwise in the figure or to allow the fixing roller to be rotated integrally with the first driven gear 46. That is, in the state when the fixing belt 32 is frictionally engaged with the pressing roller 26 and the fixing roller 24 is frictionally engaged with the fixing belt 32 to allow the fixing roller 24 and the fixing belt 32 to be driven (or dragged) by the pressing roller 26, the peripheral speed of the fixing roller 24 rotated clockwise in the figure is arranged to be equal to that of the pressing roller 26, and the rotational speed of the fixing roller 24 is arranged to be slightly higher than that of the driven gear 46.

Description of Pressing Roller 26

As described above, the pressing roller 26 comprises the core 26A rotatably pivoted on the side plate 16 through a bearing 54, and a roller body 26B disposed on the periphery of the core 26A coaxially therewith. The pressing roller 26 is arranged to have an outer diameter of 24 mm. In this embodiment, the core 26A is formed of an iron pipe having an outside diameter of 21 mm and a wall thickness of 2 mm, and the roller body 26B is formed of a silicone rubber heat-resistant resilient material (specifically, having an ASKER C hardness of 74–75 degree on the roller harder than the fixing roller 24) having a thickness of 1.5 mm which is attached to the periphery of the core 26A.

As described above, the second driven gear 50 is fixed coaxially to the shaft provided at the one end of the core 26A, and the first driven gear 46 is engaged with the second driven gear 50. A driving force from the driving gear (not shown) is directly transmitted to the second driven gear 50 to allow the pressing roller 26 to be rotatably driven counterclockwise in the opposite direction of the fixing roller 24.

In this embodiment, the pressing roller 26 is selected as a primary driving source for feeding the unfixed sheet. Thus, a gear ratio between the first and second driven gear 46, 50 is arranged such that the fixing roller 24 can keep its peripheral speed less than that of the pressing roller 26 even if the fixing roller 24 is thermally expanded. More specifically, the rotational speed as the fixing roller 24 is rotated by the driven gear 46 is arranged to be slightly lower than that as the fixing roller 24 is rotated by frictionally engaging with the pressing roller 26 through the fixing belt 32.

In this embodiment, the pressing roller 26 is not disposed directly below the fixing roller 24, but with a certain displacement from the position directly below the fixing roller 24 to the downstream side along the feeding direction of the unfixed sheet. Specifically, given that a line segment passing through both centers of the heating roller 28 and the fixing roller 24 is defined as a base line, an interior angle between the base line and a line segment passing through both the centers of the fixing roller 24 and the pressing roller 26 is arranged to be a given acute angle. The line segment passing through both the centers of the fixing roller 24 and the pressing roller 26 is arranged to be substantially perpendicular to the feeding direction of the unfixed sheet.

Description of Heating Roller 28

In this embodiment, the heating roller 28 housing a first heat source 30 comprises a core which is formed of an iron pipe having a diameter of 18 mm and a wall thickness of 0.1 mm, and a PTFE (polytetrafluoroethylene) covering layer which covers over the peripheral surface of the core and has a thickness of 20 $\mu$m. That is, in order to reduce a warm-up time, the core of the heating roller 28 is thinned. Each of both ends of the heating roller 28 is rotatably pivoted through a bearing 56, and a collar made of heat-resistant poly-ether-ether-ketone (PEEK) is inserted into each of the bearings 56 to prevent the fixing belt from being tortured or displaced during its running in endless manner.

The first heat source 30 serving as a heat-generating device is embedded in the heating roller 28. In this embodiment, the first heat source 30 is comprised of a halogen lamp having a maximum output of 800W.

Description of Tension Adjusting Mechanism for Fixing Belt 32

As described above, a tension adjusting mechanism for the fixing belt 32 in this embodiment is comprised of the second coil spring 36 for biasing the heating roller 28 in a direction causing the heating roller 28 to get away from the fixing roller 24.

More specifically, the second coil spring 36 applies a biasing force to the heating roller 28 to allow the heating roller 28 to be displaced through the slidable bracket 18 in a direction causing the heating roller 28 to get away from the fixing roller 24. Thus, the fixing belt 32 wound around both the heating roller 28 and the fixing roller 24 in an endless manner will be stretched with a given tension.

Based on the action of the second coil spring 36, the fixing belt 32 is frictionally engaged with and dragged by the pressing roller 26. Further, in response to the dragging of the fixing belt 32, the fixing roller 24 is stably driven by the pressing roller 26 without slipping or sagging with respect to the fixing belt 32.

Description of Fixing Belt 32

The fixing belt constitutes a characterizing portion of the present invention. Preferably, the fixing belt 32 has a heat capacity per square cm ranging from 0.002cal/° C. to 0.025 cal/° C. to allow the unfixed toner on the unfixed sheet S to be heated up to a fixing temperature and fixed onto the sheet without applying an excessive amount of heat.

Figure 3:
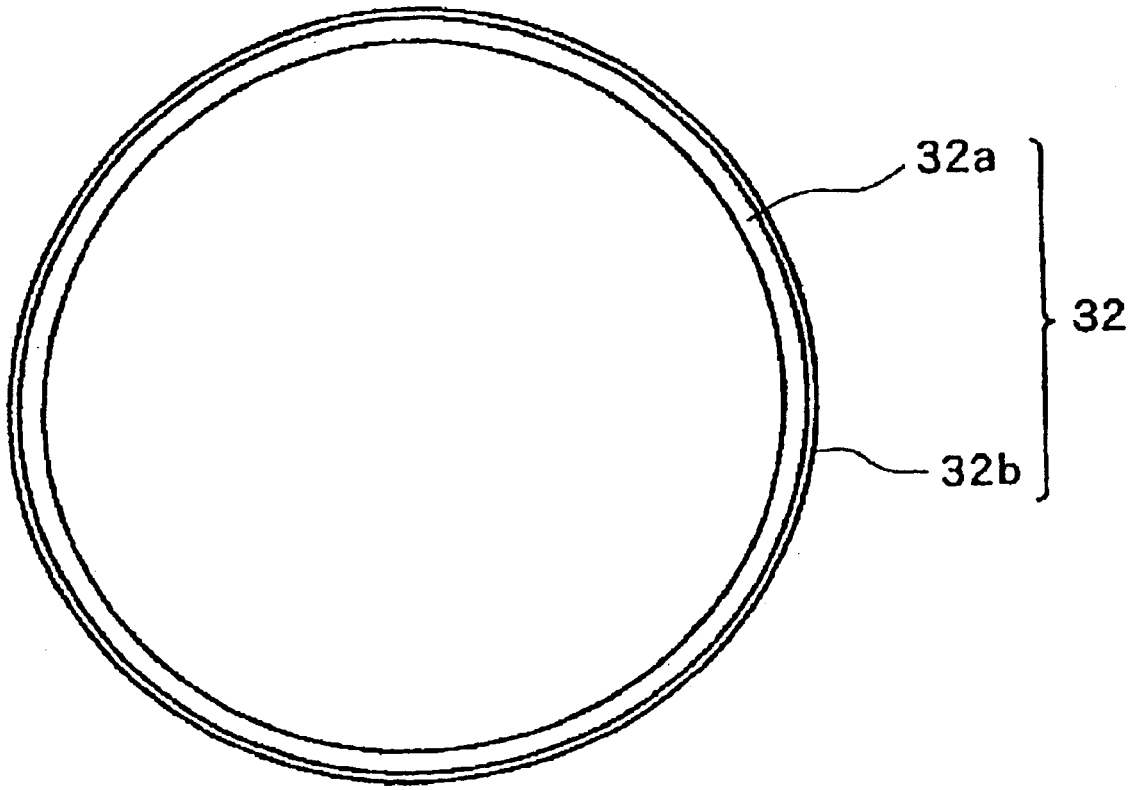
FIG. 3 is a front view showing the structure of a fixing belt of the present invention.

From this point of view, as shown in FIG. 3, the fixing belt 32 in this embodiment includes an endless-belt-shaped nickel-electroformed substrate 32*a* having an inside diameter of 55 mm and a thickness of 40 $\mu$m. Further, this embodiment employs a structure in which the surface of the belt substrate 32*a* is coated with a heat-resistant silicone rubber having a thickness of 300 $\mu$m and the periphery of the heat-resistant silicone rubber layer is further coated with a PFA heat-resistant releasing layer 32*b* having a thickness of 30 $\mu$m.

The fixing belt 32 used in the fixing apparatus having the aforementioned structure was produced as follows.

Based on the following Table 1, a solution was first prepared by blending nickel sulfamate tetrahydrate (SN) in a boric acid solution, and the solution was electrolytically refined at a low current while circulating between a container filled with activated carbon and an electrolysis vessel. After adding trisodium 1,3,6-naphthalene trisulfonate as a primary brightening agent and 2-butene-1,4-diol as a secondary brightening agent, a pit inhibitor is further added to the solution until the surface tension of the solution is reduced down to 36 mN/m, so that eight kinds of electrolytic baths A to H were prepared.

TABLE 1

| kind | SN (g/liter) | BA (g/liter) | primary brightening agent (g/liter) | secondary brightening agent (mg/liter) | content of carbon (mass %) | repeat count | current density (A/dm$^2$) | evaluation |
|---|---|---|---|---|---|---|---|---|
| A | 500 | 35.0 | 0.3 | 0 | 0.0076 | about 130,000 | 10.5 | X |
| B | ↑ | ↑ | ↑ | 60 | 0.019 | about 130,000 | ↑ | X |
| C | ↑ | ↑ | ↑ | 120 | 0.034 | about −390,000 | ↑ | X |
| D | ↑ | ↑ | ↑ | 180 | 0.048 | about 950,000 | ↑ | Δ |
| E | ↑ | ↑ | ↑ | ↑ | 0.055 | about 1050,000 | 7.88 | ○ |
| F | ↑ | ↑ | ↑ | ↑ | 0.072 | about 1170,000 | 5.25 | ○ |

TABLE 1-continued

| kind | SN (g/liter) | BA (g/liter) | primary brightening agent (g/liter) | secondary brightening agent (mg/liter) | content of carbon (mass %) | repeat count | current density (A/dm$^2$) | evaluation |
|---|---|---|---|---|---|---|---|---|
| G | ↑ | ↑ | ↑ | ↑ | 0.10 | about 1200,000 | 2.63 | ○ |
| H | ↑ | ↑ | ↑ | ↑ | 0.14 | — | 0.5 | X |

SN: nickel sulfamate tetrahydrate
BA: boric acid
Primary brightening agent: trisodium 1,3,6-naphthalene trisulfonate
Secondary brightening agent: 2-butene-1,4-diol By electroforming each of the electrolytic baths using a cylindrical stainless-steel master driven rotatably as a cathode and a titanium basket with nickel pellets as anode while agitating the electrolytic baths with maintaining a bath temperature of 60° C. and a pH of 4.5, electrocrystallized products each having a thickness of 40 $\mu$m were formed on the respective surfaces of the masters. Each of the electrocrystallized products integral with the masters was took out of the electrolysis vessel, and rinsed. After cutting or peeling off the side ends of the electrocrystallized products, the electrocrystallized products was ripped from and pulled out of the respective masters with being immersed in water. Then, the separated electrocrystallized products were rinsed and dried to form endless-belt-shaped metal substrates.

In the above forming operation, though the metal substrate A was formed without adding the secondary brightening agent of 2-butene-1,4-diol, a very slight amount (0.0076 mass %) of carbon was detected through a componential analysis of the metal substrate A. This would be caused by a very slight amount of impurities existing in the electrolytic bath and/or the primary brightening agent added to the electrolytic bath.

Each of the metal substrates A to D was formed to have a different carbon content by changing the mixing ratio of the secondary brightening agent with arranging a cathode current density at a constant value of 10.5 A/dm$^2$. However, with respect to the metal substrates E to H, an endless-belt-shaped metal substrate having higher carbon content than those of the metal substrates A to D could not be obtained from the above current density. Thus, with arranging the mixing ratio of the secondary brightening agent at the same value as that of the metal substrate D, the respective current densities for the metal substrates E, F, G and H were gradually reduced to provide different carbon contents to the respective metal substrates.

In order to measure respective fatigue strengths of the obtained endless-belt-shaped metal substrates under high-temperature atmosphere, each of the endless-belt-shaped metal substrates was cut to have a width of 20 mm through machining. Then, the endless-belt-shaped metal substrates each having a peripheral length of 172.7 mm were cut along the axial direction to obtain eight specimens A to H each having a length of 172.7 mm. However, with respect to the metal substrate H, no electrocrystallized product was formed on the surface of the master due to excessive carbon content, and thereby the specimen H was not obtained in fact.

These specimens A to G were subjected to a fatigue test according to a fatigue test system using a fatigue test apparatus (INSTRON 8871) in conformity with JIS Z 2201. In this fatigue test, each of the specimens was formed in a shape of a test piece No. 13 B defined in JIS Z 2201. Each of the test pieces was arranged to have a width W of 12.5 mm, a gage length L of 50 mm, a parallel-portion length P of 60 mm, a fillet radius R of 20 mm, and a grip width B of 20 mm. With respect to a thickness T, the thickness of each of the specimens was left unchanged according to JIS regulation.

Then, for a pretreatment, the test pieces were heated at 220° C. for 2 hours in an electric furnace. After the pretreatment, each of the test pieces was attached to the fatigue test apparatus to measure a repeat count leading up to its fracture under conditions of a repeated maximum stress of 550 N/mm$^2$, an atmosphere temperature of 250° C., and a stress cycle period of 15 Hz.

The obtained measurement result was evaluated as follows. Considering that a repeat count of a practically used nickel-electroformed belt is slightly grater than 100,000 times, one-digit-increased 1000,000 times is used as a minimum standard of "GOOD". The test piece having a repeat count less than the minimum standard is evaluated as "NG" and expressed as "X". The test piece having a repeat count approximate to the minimum standard is not evaluated as "NG" (X) because it has a positive improvement as compared to conventional belts, and expressed as "Δ". The test piece having a repeat count greater than the minimum standard is evaluated as "GOOD" and expressed as "○".

From the evaluation result, it was proved that the test piece formed of a nickel-carbon alloy having a carbon content of 0.05 to 0.12 mass % had a significant long usable life before its fracture under high-temperature atmosphere, or has a high fatigue strength.

In the case (specimen H) having a carbon content of 0.14 mass %, no electrocrystallized product is formed on the periphery of the master. The cases (specimens A to C) each having a carbon content of 0.034 mass % or less have poor durability under high-temperature atmosphere. Further, the case (specimen D) having a carbon content of 0.048 mass % generally has a decent durability under high-temperature atmosphere, which is not judged as poor durability or as "GOOD".

Thus, in the present invention, it is determined that the carbon content suitable for achieving high durability under high-temperature atmosphere is in the range of 0.05 to 0.12 mass % is, and the optimum carbon content is in the range of 0.07 mass % to 0.10 mass %.

That is, according to the present invention, an endless-shaped electroformed sheet to be used as a substrate of a fixing belt is formed of a nickel-carbon alloy and the carbon content of the nickel-carbon alloy is specified in the range of 0.05 to 0.12 mass % to provide an improved fixing belt having a desirably enhanced durability even under high-temperature atmosphere. Thus, the present invention has a highly valued industrial applicability.

It is to be understood that the present invention is not limited to the structures and materials of the above embodiment, but various modification can be made without departing from the sprit and scope of the present invention.

For example, while the above embodiment has been explained to use trisodium 1,3,6-naphthalene trisulfonate as the primary brightening agent, it is understood that the present invention is not limited to such a material, but any other suitable organic compound having a chemical structure of $=C—SO_2—$, such as saccharine or disodium 1,5-naphthalene disulfonate, may be used as the primary brightening agent.

Further, while the above embodiment has been explained to use 2-butyne-1,4-diol as the secondary brightening agent, it is understood that the present invention is not limited to such a material, but any other suitable unsaturated organic compound (having a group of C=O, C=C, C≡C, C=N, C≡N or N—C=S), such as coumarin or ethylene cyanhydrin, may be used as the secondary brightening agent.

INDUSTRIAL APPLICABILITY

As mentioned above in detail, the present invention can provide a fixing belt capable of achieving a desirably enhanced durability even under high-temperature atmosphere.

What is claimed is:

1. A fixing belt adapted to move circularly and cooperate with a pressing member to form a nip region for fixing an unfixed toner image on a recording medium, said fixing belt comprising a substrate formed of an endless-shaped electroformed sheet consisting essentially of a nickel-carbon alloy containing 0.05 to 0.12 mass % of carbon.

2. A fixing belt as defined in claim 1, wherein said carbon content is adjusted in proportion to the amount of a secondary brightening agent to be added to an electrolytic bath.

3. A fixing belt as defined in claim 2, wherein said secondary brightening agent is 2-butyne-1,4-diol.

4. A fixing belt as defined in claim 1, wherein said carbon content is adjusted in proportion to a cathode current density to be sent to an electrolytic bath.

5. A fixing belt as defined in claim 1, wherein said substrate has a surface provided with a releasing layer.

6. A fixing belt as defined in claim 1, wherein said carbon content is adjusted in a preferable range of 0.055 to 0.10 mass %.

7. A fixing apparatus comprising:

a fixing roller;

a pressing roller in rotational contact with said fixing roller at a given pressure;

a heating roller disposed apart from said fixing roller;

a fixing belt wound around both said heating and fixing rollers in an endless manner; and a heat-generating device for heating said fixing belt to heat unfixed toner on a sheet passing through a rotational contact region between said fixing and pressing rollers, whereby when the sheet having unfixed toner on a surface thereof is passed through said rotational contact region along one direction, said unfixed toner is fixed onto said sheet, wherein said fixing belt includes a substrate formed of an endless-shaped electroformed sheet consisting essentially of a nickel-carbon alloy containing 0.05 to 0.12 mass % of carbon.

8. A fixing apparatus as defined in claim 7, wherein said carbon content is adjusted in proportion to the amount of a secondary brightening agent to be added to an electrolytic bath.

9. A fixing apparatus as defined in claim 8, wherein said secondary brightening agent is 2-butyne-1,4-diol.

10. A fixing apparatus as defined in claim 7, wherein said carbon content is adjusted in proportion to a cathode current density to be sent to an electrolytic bath.

11. A fixing apparatus as defined in claim 7, wherein said substrate has a surface provided with a releasing layer.

12. A fixing apparatus as defined in claim 7, wherein said carbon content is adjusted in a preferable range of 0.055 to 0.10 mass %.

* * * * *